United States Patent [19]

Hayes

[11] Patent Number: 4,481,679

[45] Date of Patent: Nov. 13, 1984

[54] RIB PROTECTOR

[75] Inventor: John B. Hayes, Walhalla, S.C.

[73] Assignee: The Kendall Company, Walpole, Mass.

[21] Appl. No.: 434,543

[22] Filed: Oct. 15, 1982

[51] Int. Cl.[3] ..... A41D 13/00

[52] U.S. Cl. ..... 2/2; 128/518 B

[58] Field of Search ..... 2/2, 102; 128/78, 518 R, 128/518 B

[56] References Cited

U.S. PATENT DOCUMENTS

| | | | |
|---|---|---|---|
| 3,162,861 | 12/1964 | Gustafson | 2/2 |
| 3,921,222 | 11/1975 | Hollman | 2/2 |
| 4,373,211 | 2/1983 | Goudreau et al. | 2/2 |

*Primary Examiner*—Louis K. Rimrodt

[57] ABSTRACT

A contact sport rib protector adapted to cover the ribs, including the lower rib cage, of a wearer. The protector includes a flexible member having a soft, resilient, rib-contacting, inner membrane and a tough, relatively resilient, outer protective membrane. The outer member has a plurality of discrete foam-filled, protective protrusions spaced from one another by thin areas.

16 Claims, 10 Drawing Figures

FIG 1
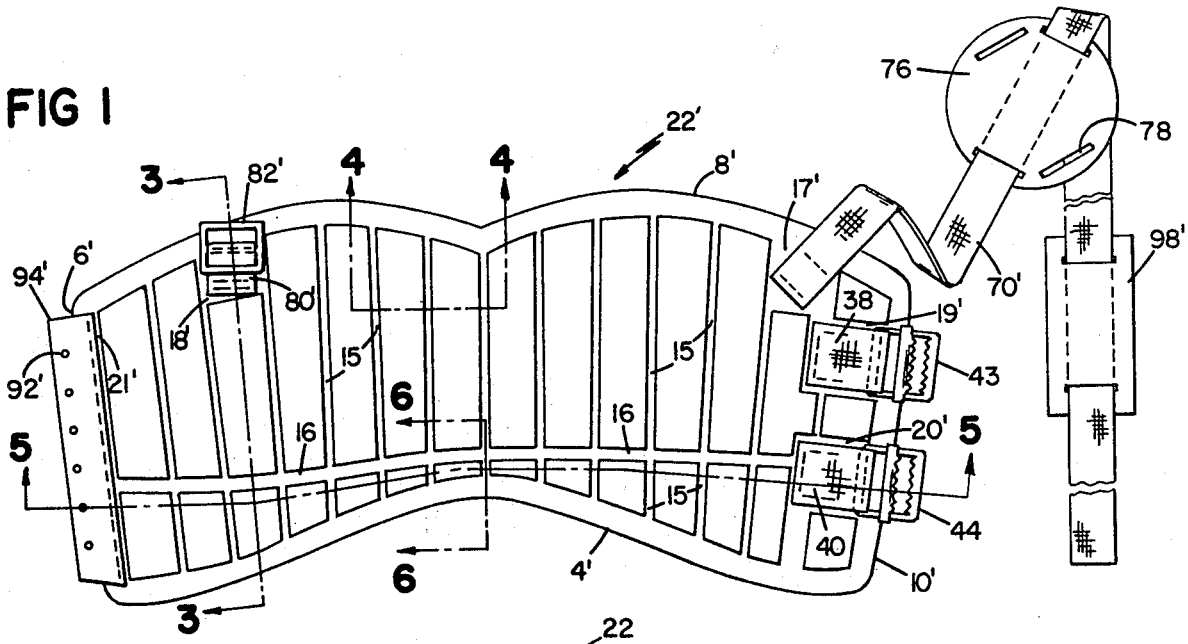
FIG 2
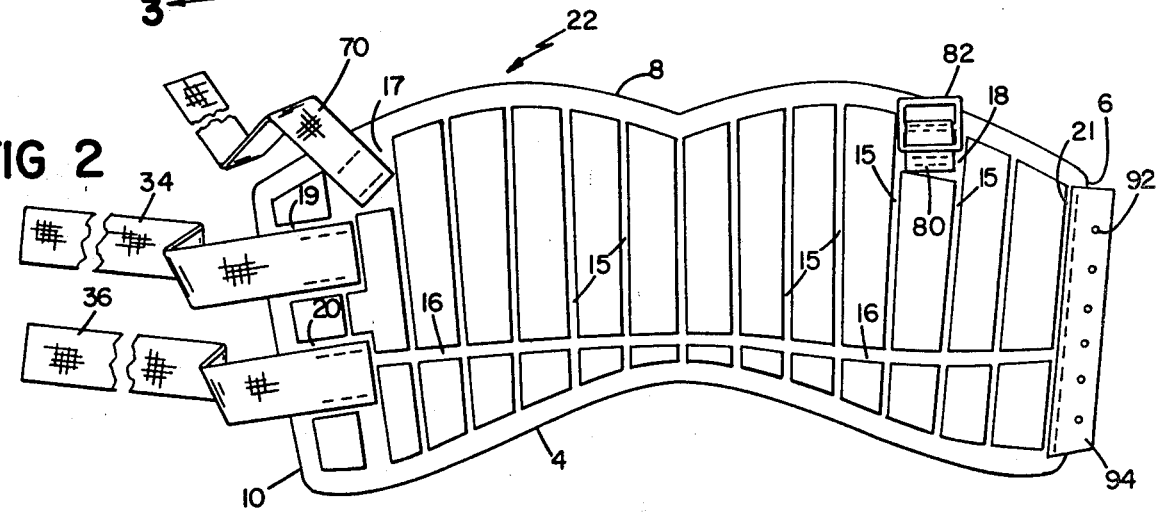
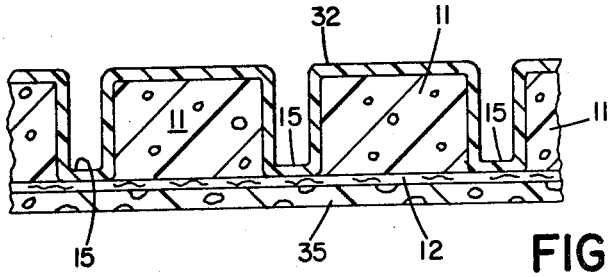
FIG 4
FIG 3
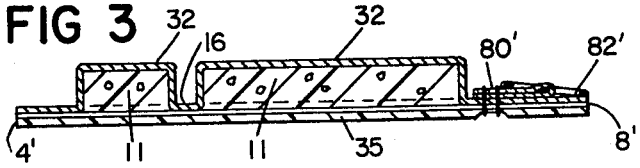
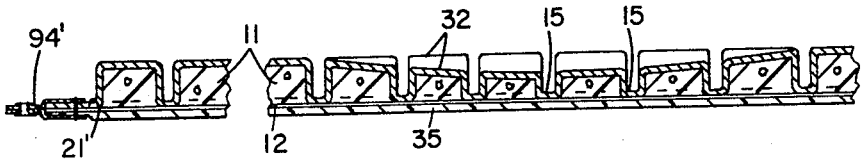
FIG 5
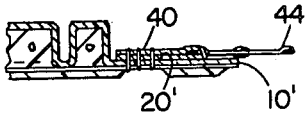

FIG 6
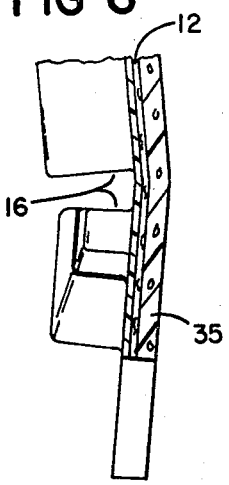
FIG 6A
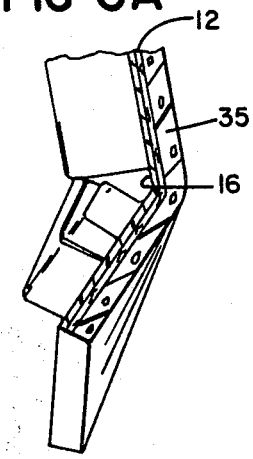
FIG 7
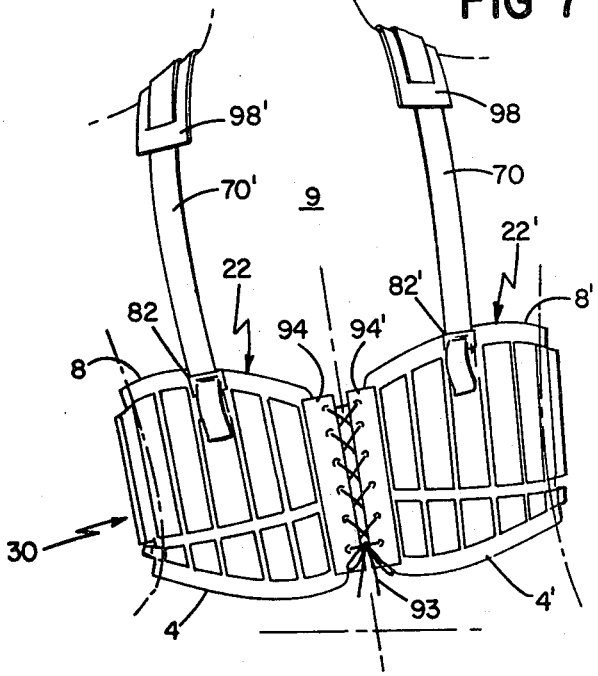
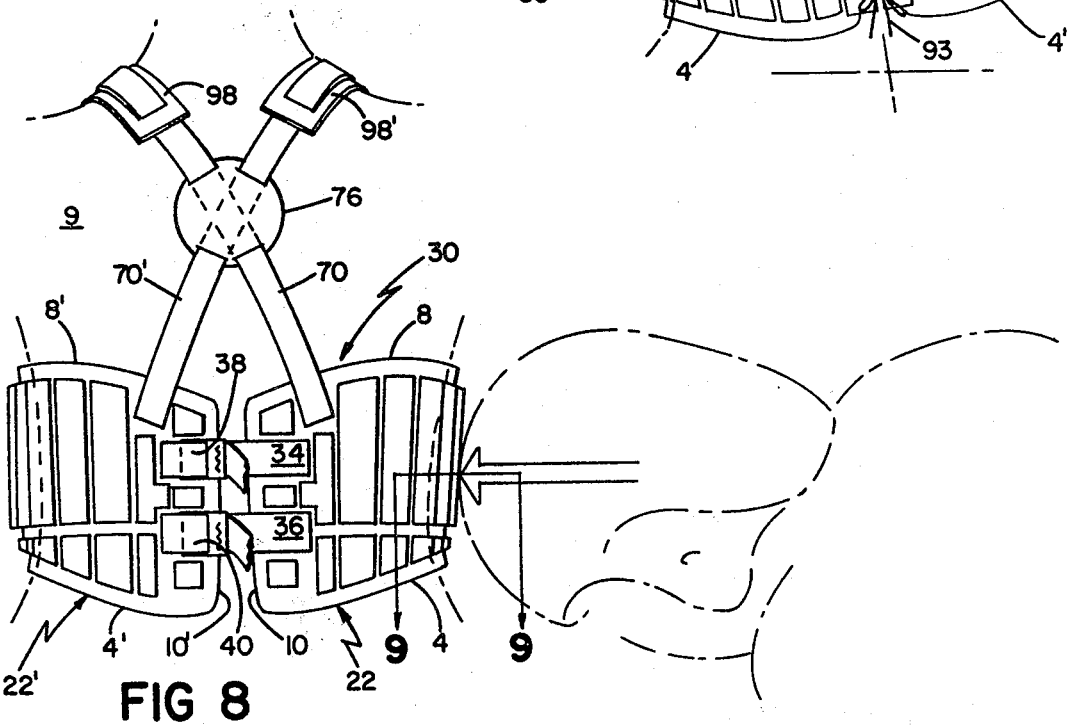
FIG 8
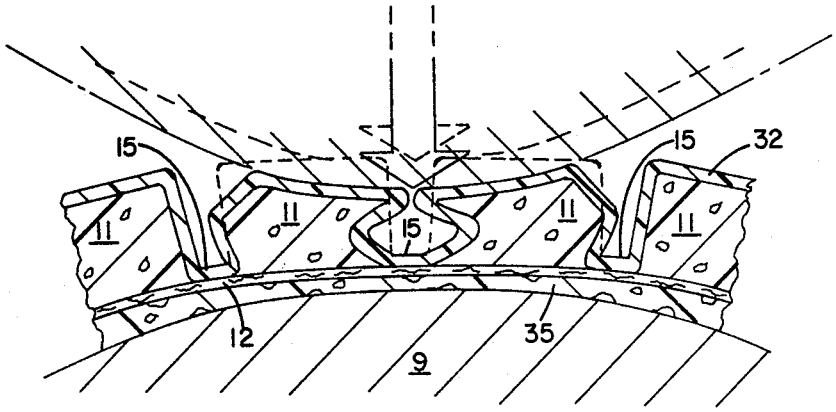
FIG 9

RIB PROTECTOR

BACKGROUND OF THE INVENTION

This invention relates to contact sport rib protectors and, more particularly, to protective rib padding for protecting the lower portion of the rib cage of football players.

In the sport of football, a variety of protective gear has been developed to protect various parts of a player's body, such as his head, shoulders, thighs, and knees. Protective gear has also been designed to protect the lower portion of a player's rib cage after an injury, such as broken ribs, has been sustained. Protectors combining heavy plastic and air bags are capable of taking direct blows but are deficient in several aspects. For example, they are unduly bulky and unwielding, fairly heavy and hot to wear, and seriously impede the movements of the athlete. Therefore, although players wear them to protect sustained rib injuries, they do not wear them to prevent such harm in the first place.

Accordingly, it is a major object of the present invention to provide a novel rib protector that protects the lower portion of the rib cage, allows the free movement of the athlete, is light-weight and relatively cool to wear, and can be worn habitually to prevent rib injury.

In order to accomplish the above and still further objects, the present invention provides a contact sport protective rib padding adapted to cover the ribs, including at least the lower portion of the rib cage. The protective rib padding comprises at least one flexible member having a tough, relatively resilient outer protective layer and a soft, resilient, rib-contacting, inner layer, the layers being connected together around the peripheral edge of the member. The outer layer has a plurality of discrete foam-filled protective protrusions spaced from one another by thin, substantially foam-free areas which include longitudinal hinge areas and at least one transverse hinge area.

The longitudinal hinge areas are transversly spaced from one another, and define a plurality of longitudinally extending rib-protective protrusions. Preferably, the longitudinal hinge areas extend between the upper and lower peripheral edges of the member.

The transverse hinge area enables the longitudinal protrusions to bend, with the wearer, at a point intermediate the length. Preferably, at least one transverse hinge area extends between the opposite peripheral side edges of the member.

In the preferred embodiment, the member is made from integrally molded left and right portions, buckled together in the rear by a pair of elastic straps and buckles attached to the rear peripheral side edges, and laced and tied together in the front by a string laced through lacing pockets attached to the front peripheral side edges. Adjustable suspender straps, having a rear crossover plate, shoulder guards and front buckles, provide height adjustment for proper vertical fit to the wearer. The elastic securing straps, suspender straps, buckles, and the lacing pockets are attached to appropriately placed, substantially foam-free areas of the protector.

Other objects, features, and advantages of the present invention will appear from the following detailed description of a preferred embodiment thereof, taken together with the accompanying drawings, wherein:

FIGS. 1 and 2 are plan views of the outer surfaces of molded blanks of the rib protector of the present invention.

FIGS. 3 through 5 are cross-sectional views of the rib protector of FIG. 1, taken along lines 3—3, 4—4 and 5—5 thereof;

FIGS. 6 and 6A are cross-sectional views of the rib protrusions shown in FIG. 5, taken along line 6—6 thereof;

FIG. 7 is a perspective front view of the rib protector of the present invention, shown as secured to the ribs of a wearer and bending in response to bending by the wearer.

FIG. 8 is a perspective rear view of the rib protector of FIG. 6, shown as absorbing a blow to the wearer.

FIG. 9 is a cross-sectional view of the rib protrusions shown in FIG. 8, taken along line 9—9 thereof.

Referring to the drawings, the flexible contact sport rib protector of the present invention, generally designated 30, is shown as a blank in FIGS. 1 through 5 and is shown in FIGS. 7 and 8 as worn on a torso, generally designated 9.

Rib protector 30 is adapted to cover the lower portion of the rib cage and, as shown in FIGS. 1–4, includes right and left flexible integrally molded members 22, 22' which are laced and buckled together to form the complete protector. Right member 22 is the mirror image of left member 22' in construction and design. Each member 22, 22' comprises a central core, comprising a plurality of discrete transversely-spaced, generally vertically-extending, foam protrusions 11 bonded to a sheet 12 of double knit polyester, a tough resilient outer layer 32 and a $\frac{3}{4}$ inch thick soft resilient inner layer 35. The peripheral edges of the inner and outer layers extend beyond the protrusions 11 of the core about $\frac{1}{2}$ inch along the peripheral side edges, and about 1 inch along the top and bottom peripheral edges, and are bonded together to opposite sides of the top of sheet 12, as best shown in FIGS. 3 and 5. The width of protrusions 11, as best shown in FIGS. 1, 2 and 5, varies from about $\frac{7}{8}$ inch in the lower portion of the rib protector 40 to about $1\frac{1}{8}$ inch in the upper portion near upper peripheral edge 8. The thickness of the foam protrusions, as best shown in FIG. 5, varies from 3/16 inch in some lower portions of protector 30 to about $\frac{5}{8}$ inch in the upper portions. The total thickness of the protector, then, varies from about 1 to $1\frac{1}{2}$ inches.

As shown in FIGS. 1–4, thin hinge areas are provided between adjacent foam protrusions 11 to provide both flexibility and increased blow-absorption. Longitudinally-extending, essentially parallel hinge areas 15 extend from upper edge 8 to lower edge 4; and a transversely extending hinge area 16 extends from front edge 6 to rear edge 10 a short distance (varying from $1\frac{1}{2}$ to $2\frac{3}{4}$ inches) above the lower edge 4 of member 22. Each hinge area 15 is about $\frac{1}{8}$ inch wide, and transverse hinge area 16 is about $\frac{1}{4}$ inch wide. As shown in FIGS. 3–5, each hinge area is substantially free of foam and the portion of outer layer 32 at the hinge is essentially in contact with the front surface of sheet 12 of the core. The protrusions 11 below hinge areas 16 define a set of lower rib-protective protrusions; those above hinge areas define upper rib-protective protrusions.

In the preferred embodiment, protrusions 11 are $\frac{1}{2}$ inch, 2 pound polyethylene foam, such as that sold by Frelen Corporation under the brand name Frelen. Outer protective layer 32 is a membrane of $\frac{1}{4}$ inch, 11 pound cross-link polyurethane foam such as that also sold under the brand name Frelen; and inner layer 35 is a sheet of ¾ inch urethane foam such as poly-ether (or of some other suitable foam material that will absorb shock and mold itself through wear to the contours of the user). The core and outer layer 32 are molded together to form a composite, and a sheet 12 of 150 denier double-knit polyester material (weighing 6 ounces/yd$^2$) is attached to the inner layer of the composite. After various attaching straps (and the like) are sewn to the composite and sheet, the inner layer 35 is glued to sheet 16.

As shown in FIG. 1, the upper peripheral edge 8 of the composite member 22 is curved to conform to the curve of the lower and side edges of the player's shoulder pads and arm pads. Lower peripheral edge 4 is curved to conform to the curve of the top edge of hip pads. Front peripheral edge 6 and rear peripheral edge 10 are generally straight, but slightly upwardly diverging, having wider transverse distances between them at their upper portions than at their lower portions.

Other substantially foam-free areas are provided for attaching the straps, etc. used to attach the protector 30 to a user. On member 22, these areas include suspender strap area 17, suspender buckle area 18, rear strap areas 19, 20, and lacing pocket area 21. Member 22' includes suspender strap area 17', suspender buckle area 18', rear buckle areas 19', 20', and lacing pocket area 21'.

Rear strap areas 19, 19' are adjacent to rear edges 10, 10' near upper edges 8, 8'. Rear strap areas 20, 20', adjacent edges 10, 10' below areas 19, 19', overlap hinge areas 16, 16'. Elastic securing straps 34, 36 are sewn to areas 19, 19'. Rear buckle straps 38, 40, are sewn respectively to areas 19', 20'. Rear metal buckles 43, 44 are attached to rear buckle straps 38, 40, and are adapted to receive elastic straps 34, 36 to releasably secure the rear of members 22, 22', as shown in FIG. 8.

The front peripheral edges of members 22, 22' include lacing pocket areas 21, 21' to which are sewn lacing pockets 94, 94' of a durable material such as plastic-coated textile fabric. Pockets 94, 94' have two sets of six metal eyelets 92, 92' through which lacing string 93 may be laced for releasably securing the front of members 22, 22', as shown in FIG. 7.

The suspender strap areas 17, 17' are adjacent to upper peripheral edges 8, 8' near rear edges 10, 10'. Suspender straps 70, 70' are sewn to areas 17, 17' and overlap through cross-over plate 76, which is a generally flat circular plate having four slots 78. Each suspender strap 70, 70' has a shoulder guard 98, 98', which is a piece of ⅜ inch urethane foam that is 1½ inches wide and 10 inches long. The foam, which is laminated with an outer layer of vinyl, has a pair of slots to allow a suspender strap 70, 70' to be passed through guard 98, 98'.

Suspender buckle strap areas 18, 18' are adjacent to upper peripheral edges 8, 8' near front edges 6, 6'. Suspender buckle straps 80, 80', sewn respectively to areas 18, 18', hold metal buckles 82, 82', adapted to respectively receive suspenders 70', 70.

In use, as best shown in FIGS. 7 and 9, rib protector 30 is secured to the wearer to protect the ribs from potential injury. The wearer buckles rear peripheral edges 10, 10' together using elastic straps 34, 36 and buckles 38, 40. He then places the secured rear portion behind his back, crosses suspender straps 70, 70' (which overlap through cross-over plate 76) over his shoulders, and buckles suspenders 70', 70 to the front of protector 30, using suspender buckles 82, 82'. The wearer then adjusts shoulder guards 98, 98' to fit at his shoulders, laces string 93 through eyelets 92, 92' in lacing pockets 94, 94' and conventionally ties string 93 in place.

Each wearer of rib protector 30 is ensured an exact, slip-free fit because hinge areas 15, 15', 16, 16' allow the protector to bend to fit the contours of each individual wearer. Further, lacing pockets 94, 94', string 93, rear buckles 38, 40 and straps 34, 36 provide width adjustment, while suspender straps 70, 70' and buckles 82, 82' provide height adjustment. Shoulder guards 98, 98' prevent the suspender straps 70, 70' from chafing or slipping off the player's shoulders.

The wearer retains freedom of movement because the protector itself is light-weight and not bulky; and further because the transverse hinge areas 16, 16', which are located to correspond to the lower perimeter of the player's rib cage, allow the protector to bend when the wearer bends.

Finally, the wearer is ensured effective protection from rib injuries because, as best seen in FIGS. 8 and 9, the protrusions 11 extend generally perpendicular to the wearer's ribs, and force of a direct blow is distributed and absorbed by the distortion of the outer layer 32 and the hinge areas 15 and by the compression of the foam-filled protrusions and inner layer 35.

Other embodiments are within the following claims.

What is claimed is:

1. A contact sport rib protector adapted to cover at least the lower rib cage of a wearer, said protector comprising:

at least one flexible composite, laminated member having a tough, relatively resilient, outer protective membrane extending throughout the member and overlying and secured to a soft, resilient, rib-area-contacting inner membrane, said outer membrane having a plurality of narrow, vertically extending, foam-filled, rib-area-protective protrusions spaced from one another by narrow, transversely spaced, longitudinally extending hinge areas extending between the top and bottom edges of said member and by at least one narrow, transversely extending hinge area located between the top and bottom edges of said member and extending between the opposite side edges of said member generally perpendicular to said longitudinally extending hinge areas, said hinge areas comprising portions of said outer membrane essentially in contact with said inner membrane, whereby said hinge areas define said plurality of rib protective protrusions therebetween and permit bending of said protector thereat.

2. The rib protector of claim 1 including a pair of said members secured to each other along the vertical edges thereof.

3. The rib protector of claim 2 wherein said members are substantially mirror-images of each other.

4. The rib protector of claim 2 wherein one of said members is a left member adapted to cover the left ribs of a wearer, the other of said members is a right member adapted to cover the right ribs of a wearer, and said protector includes first securing means to secure the fronts of said members together and second securing means to secure the backs of said members together.

5. The rib protector of claim 4 wherein at least one of said securing means is adjustable to vary the circumferential size of said rib protector.

6. The rib protector of claim 4 wherein said first securing means comprises lacing pockets located on the front peripheral edges of said pair of members.

7. The rib protector of claim 4 wherein said second securing means comprises elastic straps and cooperating buckles.

8. The rib protector of claim 1 wherein said protrusions are of greater width and thickness adjacent lower portions thereof than adjacent an upper portion thereof.

9. The rib protector of claim 1 wherein said protrusions have thicknesses in the range of $\frac{1}{4}$ inch to $\frac{3}{4}$ inch and widths in the range of $\frac{3}{4}$ inch to $1\frac{1}{4}$ inch.

10. The rib protector of claim 1 wherein said hinge portions are about $\frac{1}{8}$ to about $\frac{1}{4}$ inch wide.

11. The rib protector of claim 1 wherein said outer membrane is a $\frac{1}{4}$ inch, 11 pound cross-linked polyurethane foam.

12. The rib protector of claim 1 wherein said inner membrane is a urethane foam about $\frac{3}{4}$ inch thick.

13. The rib protector of claim 1 including adjustable suspenders for varying the vertical positioning of said rib protector on a wearer.

14. A contact sport rib protector adapted to cover at least the lower rib cage of a wearer, said protector comprising:

a pair of flexible, composite, laminated members, each of said members having a core, a tough, relatively resilient, outer membrane extending throughout the member and a soft, resilient, rib-area-contacting foam inner membrane, said core comprising a plurality of narrow, rib-area-protective foam protrusions mounted on one side of a flexible sheet, a plurality of narrow, longitudinally extending hinge areas intermediate adjacent ones of said foam protrusions, and a narrow, transversely extending hinge area located between the top and bottom edges of said member and generally perpendicular to said longitudinally extending hinge areas, said outer membrane being secured to said sheet of said core at said hinge areas and said inner membrane being secured to the side of said sheet opposite said outer membrane, each of said hinge areas including a region of substantially less thickness than said protrusions, said regions of said longitudinally extending hinge areas extending generally from the top to the bottom of the respective one of said members and said regions of said transversely extending hinge areas extending generally from one side edge to the opposite side edge of the respective one of said members, each of said protrusions having a greater thickness and width adjacent a lower portion thereof than at an upper portion thereof, the thicknesses of said protrusions being in the range of about $\frac{1}{2}$ to $\frac{3}{4}$ inch and the widths of said protrusions being in the range of about $\frac{3}{4}$ to $1\frac{1}{4}$ inch, and each of said regions of said hinge areas having a width in the range of about $\frac{1}{8}$ to about $\frac{1}{4}$ inch whereby said hinge areas permit bending of said protector thereat.

15. The rib protector of claim 14 wherein each of said members includes a peripheral edge region generally surrounding said rib protrusions and of thickness substantially less than that of said rib protrusions.

16. The rib protector of claim 15 wherein each of said members includes first securing means for attaching the fronts of said members to each other and second securing means for attaching the backs of said members to each other, each of said securing means being attached to the respective one of said members at a region adjacent a peripheral edge of said respective member and of thickness substantially less than that of said rib protrusions.

* * * * *